United States Patent [19]

Kral et al.

[11] Patent Number: 4,850,511

[45] Date of Patent: Jul. 25, 1989

[54] DISPENSING RACK

[75] Inventors: Rudy Kral, Clifton, N.J.; Joseph Mason, Huntington, N.Y.

[73] Assignee: M&M/Mars, Hackettstown, N.J.

[21] Appl. No.: 40,572

[22] Filed: Apr. 17, 1987

[51] Int. Cl.[4] ..... A47F 1/08

[52] U.S. Cl. ..... 221/154; 221/197; 221/242; 221/287; 221/306; 221/311; 312/42; 49/449

[58] Field of Search ..... 221/12, 154, 241, 242, 221/287, 306, 197, 311; 312/42; 211/59.2, 14, 15, 184, 4; 49/449, 450

[56] References Cited

U.S. PATENT DOCUMENTS

| | | | |
|---|---|---|---|
| 1,558,748 | 10/1925 | Muck | 49/450 |
| 3,172,713 | 3/1965 | Rupert | 221/154 |
| 3,674,175 | 7/1972 | Jaquish | 221/311 X |
| 4,682,826 | 7/1987 | Mestdagh | 211/4 X |

FOREIGN PATENT DOCUMENTS

| | | | |
|---|---|---|---|
| 502004 | 3/1939 | United Kingdom | 312/63 |

*Primary Examiner*—H. Grant Skaggs

*Attorney, Agent, or Firm*—Curtis, Morris & Safford

[57] ABSTRACT

A display rack for dispensing packaged items from a vertical stack of items contained within magazines which are interchangeably received and retained by columns within a housing. The leading item within each magazine may be withdrawn through the discharge opening of the housing and upon withdrawal, a next leading item will be placed in a position for withdrawal as a result of the positive gravity feed of the magazine. A guard is provided which covers the discharge opening of the housing thereby preventing access to the packaged items within the magazines. The display rack also includes a means for locking the guard in first and second positions.

51 Claims, 14 Drawing Sheets

FIG. 14A
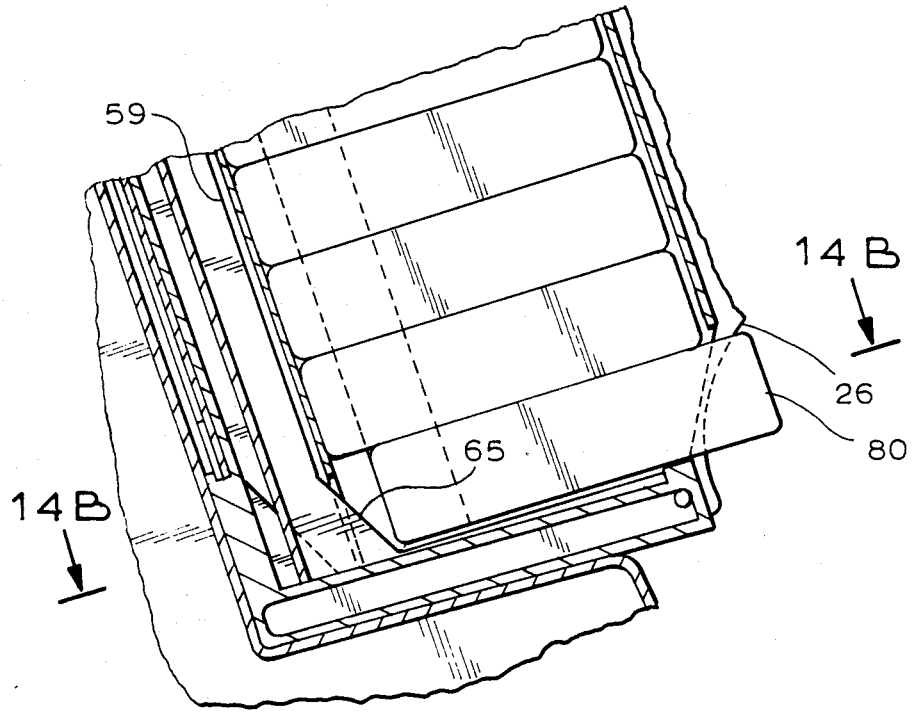
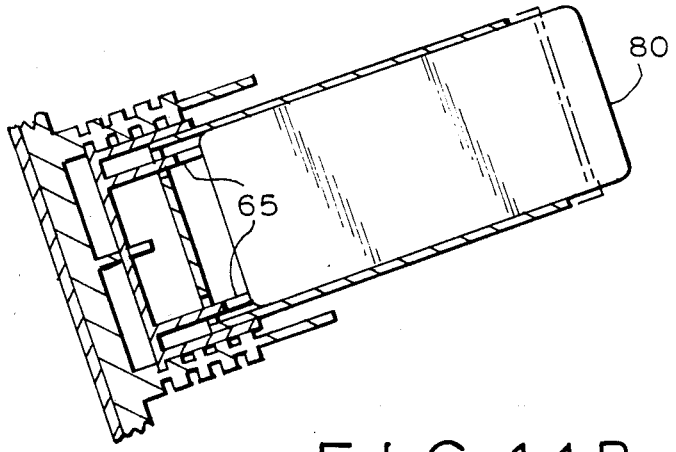
FIG. 14B

DISPENSING RACK

BACKGROUND OF THE INVENTION

The present invention generally relates to a display rack for dispensing packaged items and, more particularly, to a theft-resistant display rack which receives varying sizes of magazines containing a vertical stack of packaged items interchangeably within columns therein. The display rack includes a novel guard lock design which minimizes pilfering of the packaged items when the dispensing rack is not in use.

In recent years, there has been a substantial increase in the consumption of packaged candy bars, as well as packaged coated peanut and chocolate candy. A consumer frequently buys confectionery products as a snack for after a meal, such as at a cafeteria or restaurant check-out line. The most often used method by which a cafeteria or restaurant will sell these confectionery products to the public is by displaying these products often in simple racks or in open boxes. These methods of display obviously allow for easy pilfering of the products. In addition, these methods have the apparent disadvantage that an adequate inventory of a product at the end of the business day cannot be easily ascertained.

The prior simple display racks used for such items generally only retain one size of vertically stacked products, such as cigarettes. This type of display rack precluded different sized products from being dispensed. In addition, such simple display racks failed to provide for any measure of inventory control. For effectiveness, it is necessary that a display rack containing packaged items, such as packaged candy bars and packages containing coated peanut and chocolate candy, provide for the retention of different sized magazines containing the vertically stacked packaged items as the size of each package varies. Therefore, a display rack must be designed in such a way that varying sizes of the magazines may be inserted and retained interchangeably within the columns of the display rack.

The hallmark of a cafeteria is the rapid serving of food products to customers along the cafeteria line. Of great importance, therefore, is that delays associated with the cafeteria line be avoided. As a result, a display rack to be used in conjunction with a cafeteria line must provide for the rapid dispensing of the products housed therein as well as easy accessibility to the leading packaged item to be dispensed.

OBJECTS OF THE INVENTION

It is a general object of this invention to provide a display rack for dispensing packaged items, such as packaged candy bars or packaged coated peanut and chocolate candy for particular use along a cafeteria line or at a restaurant check-out counter.

It is a further object of the present invention to provide a display rack which receives and retains magazines containing a vertical stack of packaged items within channels in the display rack.

It is another object of the present invention to provide a display rack for housing packaged items which interchangeably receives and retains varying sizes of magazines which each contain vertically-stacked items.

It is yet a further object of the present invention to provide a guard-lock which covers the discharge opening of the display rack to prevent access to the packaged items within each magazine when the business establishment is closed.

It is yet another further object of the present invention to provide a display rack for use in cafeterias which provides for easy accessibility to the leading item to be dispensed thereby avoiding delays along the cafeteria line.

It is a further object of the present invention to provide a display rack which is compact and which will be easily accommodated by the environment in which it is used.

It is another object of the invention to provide a display rack which allows for speedy and efficient loading and dispensing of packaged items.

It is yet a further object of the present invention to provide a simple and efficient means to inventory the remaining supply of packaged items within each associated magazine housed within the display rack at the end of each business day.

It is also a further object of the present invention to provide a display rack which is simple and easy to use by both the vendor and consumer.

It is yet a further object of the present invention to provide a display rack which is designed such that it will fit within a confined space along the cafeteria line or mounted to a confined wall surface.

Other objects and advantages of the invention will become apparent from the following detailed description and from the appended drawings in which like numbers have been used to describe like parts of the several views.

SUMMARY OF THE INVENTION

This invention relates to a display rack for dispensing packaged items which are vertically-stacked within differing sized magazines which are interchangeably inserted and retained within variably sized columns associated with the display rack.

The display rack of the present invention includes a plurality of vertical columns in the housing of the display rack. Each column is formed by a pair of partition members which are disposed outwardly from the inner surface of the rear face of the housing and which are in spaced relationship with each other such that the columns are of varying widths. The surface of each partition member possesses an abutment post. The distance between abutment posts of adjacent partition members defines the width of each column. Magazines of a first size are inserted and received by the columns and lateral movement of the magazine within the columns is restrained by the abutment posts.

The abutment posts possess a plurality of vertically formed grooves which readily receive adaptors or inserts of varying sizes. These adaptors or inserts are slidingly received by and engaged within the grooves. The adaptors are thus supported between the partition members and are constrained from further vertical downward movement by the bottom face of the housing. Magazines of a second and third size are received by the adaptors or inserts. Lateral movement of the magazines within the inserts is restrained by vertical retention members of the adaptors.

In this way, the display rack of the present invention is able to accommodate a variety of sizes of magazines which may be interchanged among the columns. The magazines in turn may support varying sizes of packaged items.

When in use, the discharge opening of the housing is aligned with the discharge outlet of each magazine so that the leading packaged item may be withdrawn through the discharge opening from the display rack. Upon each successive withdrawal of a leading packaged item, the positive gravity feed associated with each magazine permits the next leading packaged item to be placed in a position where it can be subsequently withdrawn.

The present invention provides for a pilfer-resistant display rack. A guard slidingly adjacent to the back of the front face of the housing is movable between a first position, wherein the guard is removed from the discharge opening permitting access to the leading item within each magazine, and a second position, wherein the guard covers the discharge opening preventing access to the packaged items within the magazine. A pivotally mounted lever is displaceable between initial, intermediate and final positions. In the initial position, a first slot of the lever engages a clip mounted to the guard to thereby lock the guard in its first position. In this initial position, the lever is also restrained from further movement by a first restraining member. When the clip disengages the first slot, the lever is pivoted away from the clip to its intermediate position abutting a second restraining member so that the guard may be moved upwardly into its second position. The lever is subsequently pivoted downwardly into its final position wherein a second slot in the lever engages the clip to retain the guard lock in its second position. The guard is further restrained from downward movement in its second position by a third restraining member mounted to the front face.

To permit easy accessibility to the leading packaged item, the columns may possess one or more inclined steps extending upwardly from the bottom face of the housing between the partition members of the columns. Similarly, inclined steps and/or feet are associated with the inserts or adaptors. Corresponding grooves or notches in the first, second and third sized magazines receive the steps or feet therein so that as a result of the positive gravity feed of each magazine, when a leading packaged item is withdrawn through the discharge opening, the next leading item engages the inclined steps or feet so that a portion thereof is extended outwardly of the discharge opening for easy accessibility to the leading packaged item by the purchaser or clerk.

Each magazine also includes a means to inventory the supply of items within the magazine. Slotted openings are provided along the front surface of each magazine for directly viewing the vertical stack of packaged items within each associated magazine. Numerical indices are provided adjacent the slotted openings so that the inventory of the stack of packaged items can be easily and readily ascertained by a clerk.

BRIEF DESCRIPTION OF THE DRAWINGS

FIG. 14A is a cross-sectional side view of an enlarged section of FIG. 9.

FIG. 14B is an partial cross-sectional top view of the display rack taken along line 14B—14B of FIG. 14A.

DETAILED DESCRIPTION OF THE PREFERRED EMBODIMENT

Figure 1:
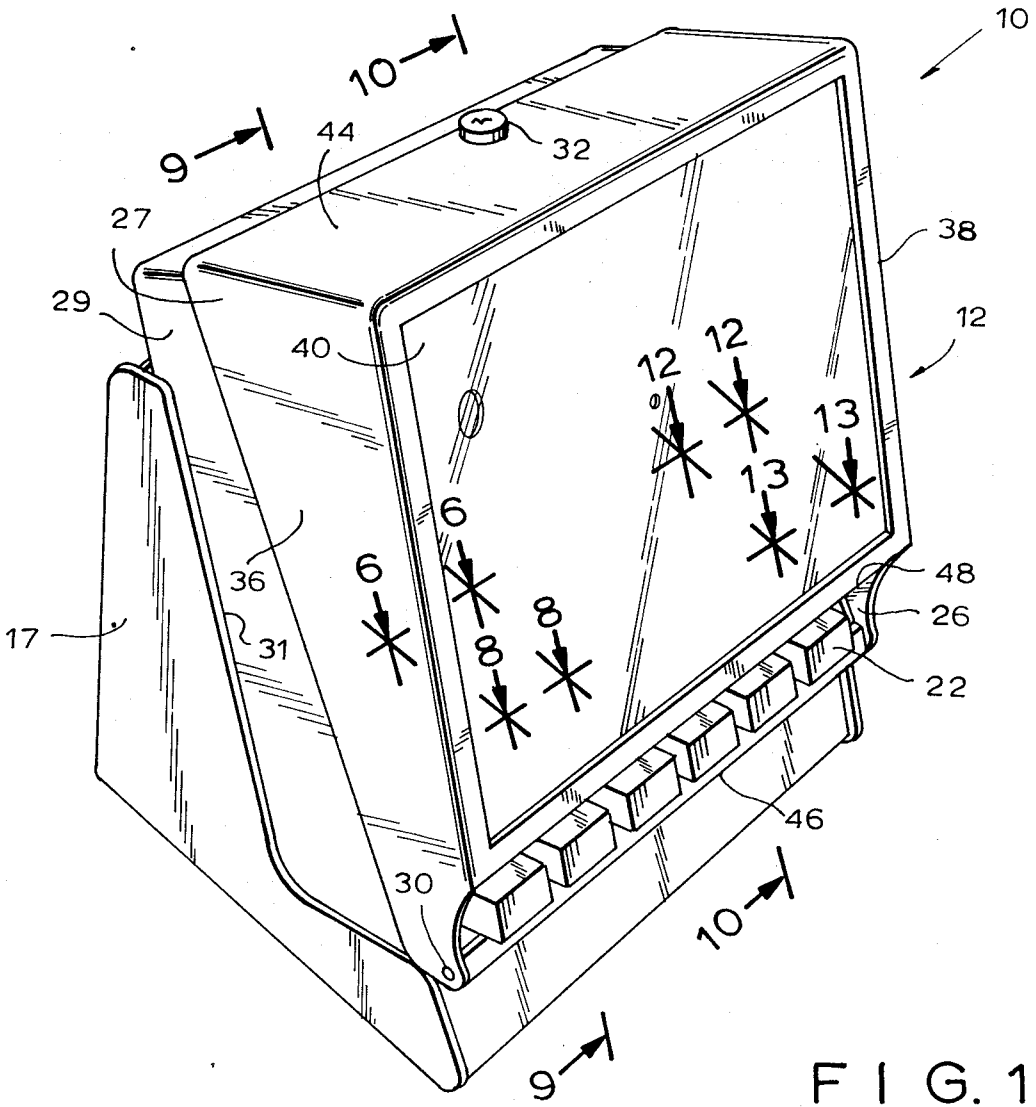
FIG. 1 is a front perspective view of a preferred embodiment of the display rack of the present invention.
Figure 2:
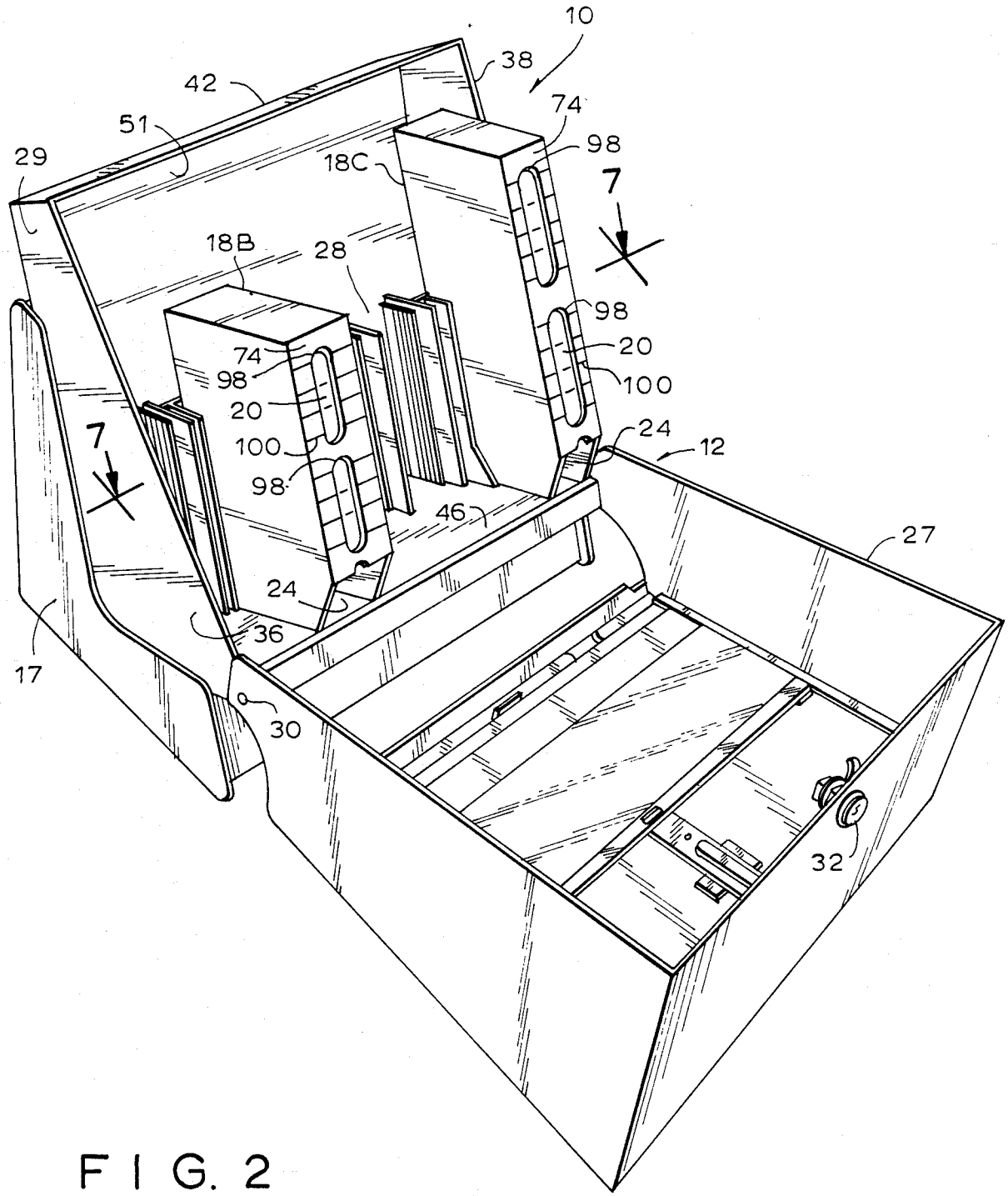
FIG. 2 is a front perspective view of the display rack with the housing shown in its open position.
Figure 3:
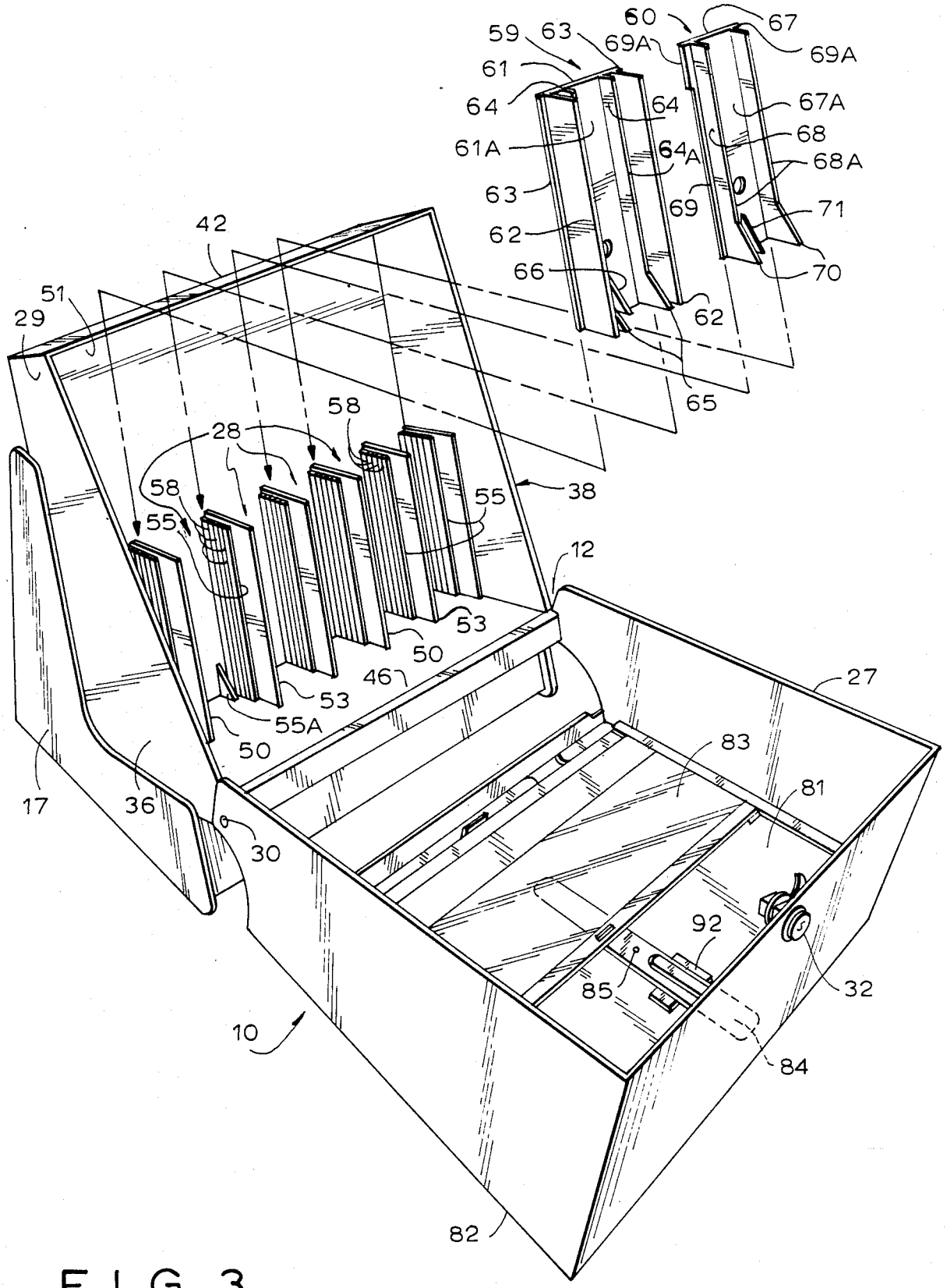
FIG. 3 is an exploded perspective view of the display rack with the housing shown in its open position.
Figure 4:
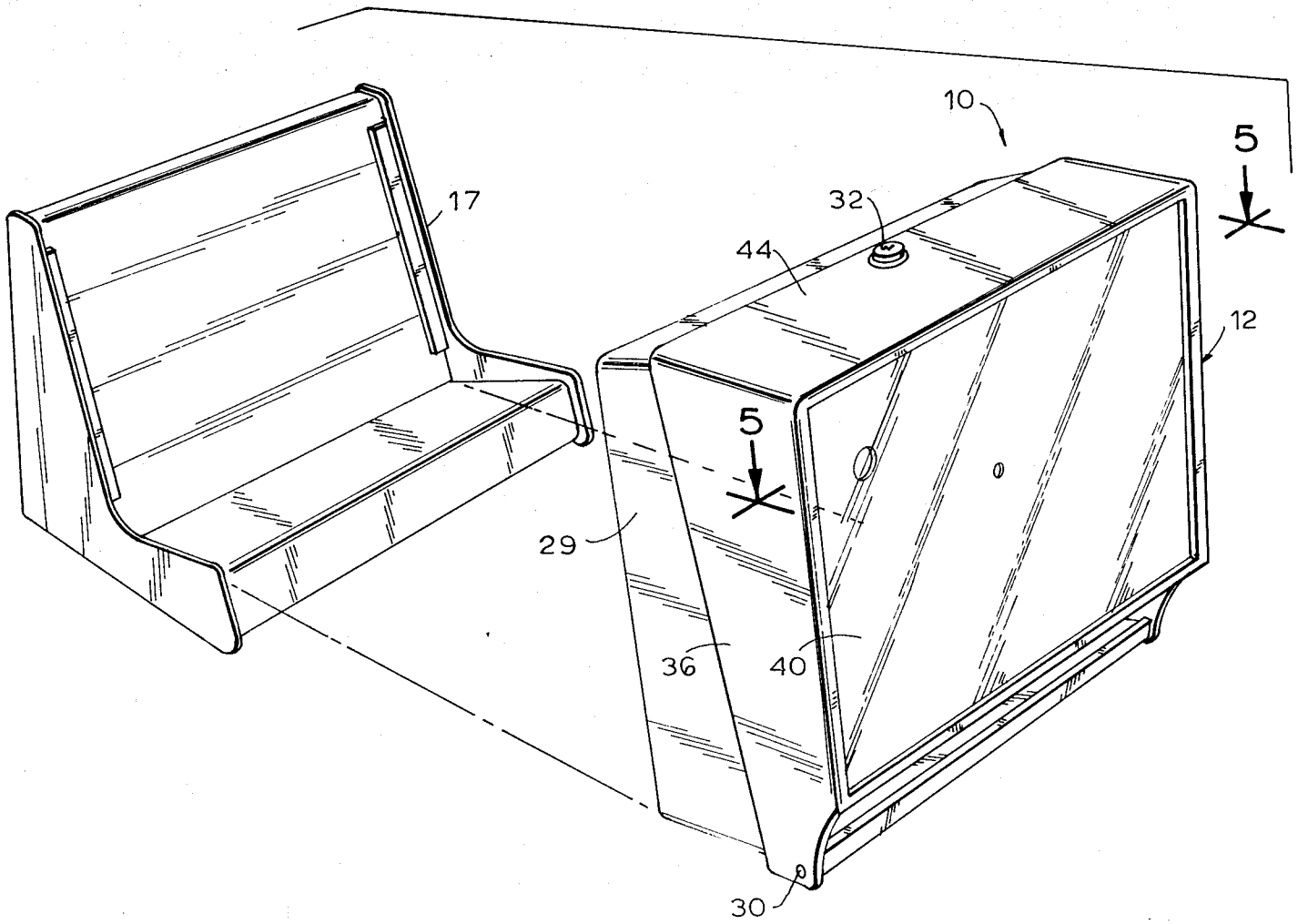
FIG. 4 is a front perspective view of the display rack with the housing removed from the display stand.

Referring to FIGS. 1, 2 and 3, a display rack 10 used particularly in conjunction with a cafeteria line or at a restaurant cashier's counter is shown. Housing 12 may be supported in any convenient manner, for example see FIG. 4 as well, on a display stand 17. The housing 12 receives and retains magazines 18 containing a vertical stack of packaged items 20 therein. As a result of the positive gravity feed of magazine 18, the leading item 22 in vertical stack 20 may be discharged through the discharge outlet 24 of magazine 18 and withdrawn through the discharge opening 26 of housing 12 by a clerk or purchaser.

The housing may be opened to obtain easy access to the packaged items (FIG. 2). Housing 12 includes first and second sections 27 and 29 separated at a mid-line 31. First and second sections 27 and 29 are hingedly connected relative to one another by a hinge or connecting rod 30 which also acts as a pivot point. Housing 12 is therefore displaceable between a closed position, as shown in FIG. 1, wherein first and second sections 27 and 29 are interlocked by means of a key lock 32, and an open position, as shown in FIGS. 2 and 3 wherein first section 27 is disengaged from second section 29 thereby permitting direct access and viewing of magazines 18 inserted within vertical columns 28 formed in housing 12.

Housing 12 includes side faces 36 and 38, front face 40, rear face 42, top face 44, and bottom face 46. The distance between free end 48 of front face 40 and bottom face 46 defines discharge opening 26.

The display rack 10 of the present invention is compact in size so that it can easily be used in a confined space, such as a cafeteria line, by means of the display stand 17. The display rack is also easily removed from the display stand so that it can be mounted to a confined wall surface. In this regard, rear face 42 of the housing possesses one or more key-holes (not shown) which facilitate wall mounting of the housing. In addition, the logo or logos of the products to be dispensed may be positioned on the front, rear and side faces of the housing 12.

Figure 5:
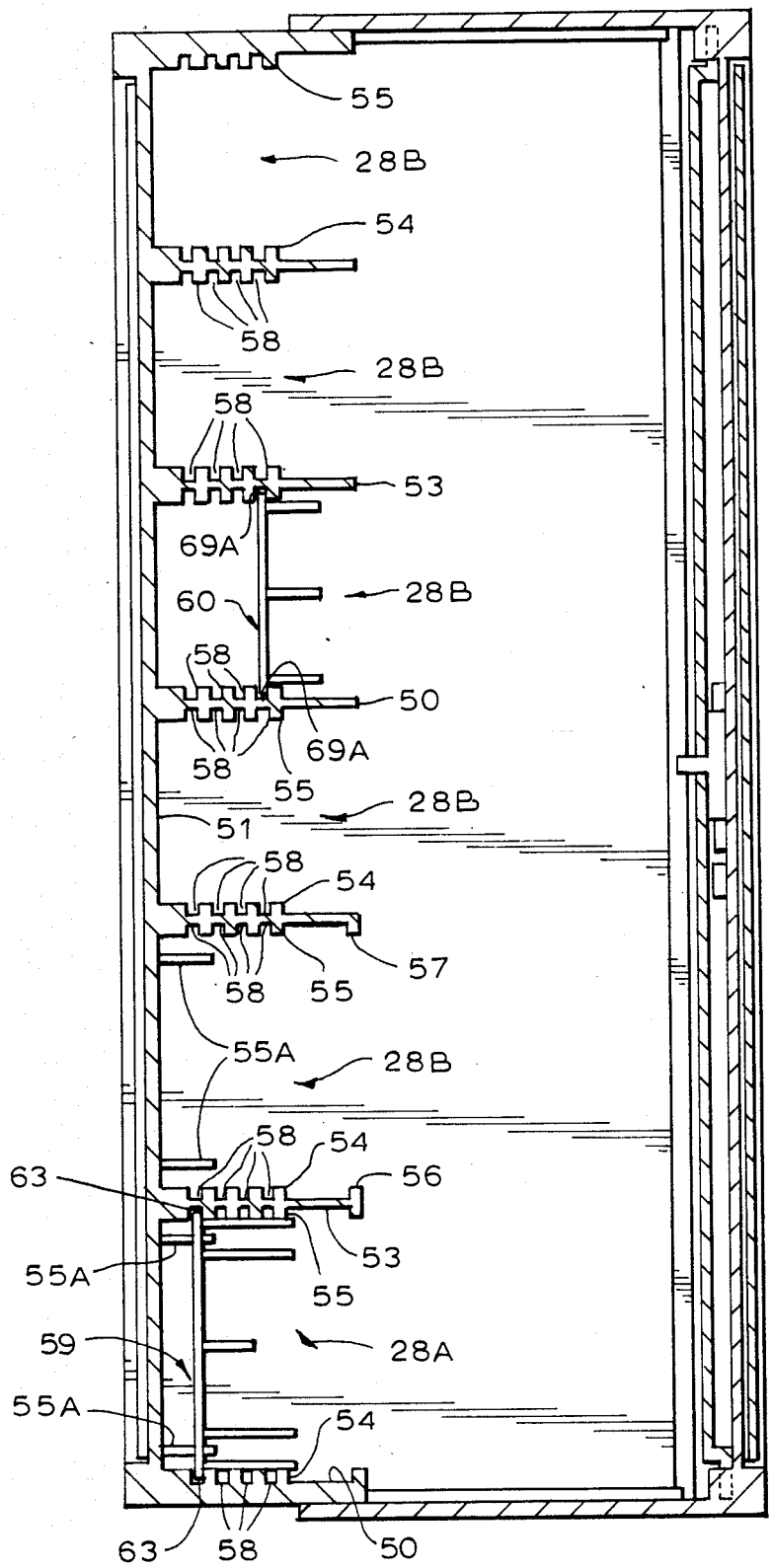
FIG. 5 is a cross-sectional top view of the display rack taken along line 5—5 of FIG. 4.

Referring now to FIG. 3, vertical columns 28 are formed by parallel partition members or vertical members 50 and 53 disposed outwardly from inner surface 51 of rear face 42. Referring also to FIG. 5, each partition member possesses abutment posts 54 and 55. The distance between abutment posts of adjacent partition members defines the width of each column. As shown in FIG. 5, there are two identical columns of a first width 28A and four identical columns of a second width 28B. A pair of downwardly inclined steps 55A are displaced between abutment posts 54 and 55 of columns 28A in spaced-apart relationship to one another. These steps 55A extend upwardly from bottom face 46 of housing 12, as best shown in FIG. 3 (only one step of the pair is shown).

Still referring to FIGS. 3 and 5, each abutment post, such as 54 and 55, includes one or more vertically formed, parallel grooves 58. The parallel grooves of adjacent abutment posts readily receive variably sized first and second inserts or adapters 59 and 60, respectively; first adapter 59 having a greater overall width than first adapter 59.

Referring now to FIG. 3, first adapter 59 has a rear face 61 with an inner surface 61A and outer parallel retention members 62 in spaced-apart relationship with each other. Outer edges 63 extend outwardly from the rear face 61 of adaptor 59 at the point of intersection of the rear face 61 and the retention members 62. The outer edges 63 slidingly engage aligned parallel grooves of adjacent abutment posts of the columns of the first width 28A (see FIG. 5). Inner retention members 64 are displaced within the outer parallel retention members 62 in parallel, spaced relationship with one another. These inner retention members 64 have facial edges 64A. Each inner retention member 64 further includes a downwardly inclined foot 65. In addition, a downwardly inclined step 66 which extends outwardly from the inner surface 61A of the rear face 61 is located midway between the inner retention members 64. Notches (not shown) are formed in rear face 61 in the area immediately between outer retention members 62 and inclined feet 65 of the inner retention members 64. When first adaptor 59 is slidingly inserted with an aligned pair of parallel grooves of adjacent abutment posts of columns 28A, these notches engage inclined steps 55A of columns 28A so as to provide a stable, snug fit of first adaptor 59 against bottom face 46 of housing 12 (see FIG. 5). In addition, bottom face 46 restrains adaptor 59 from further vertical downward movement (see FIG. 9).

Still referring to FIG. 3, second adaptor 60 has a rear face 67 with an inner surface 67A and parallel retention members 68 in spaced-apart relationship with one another. Outer edges 69 project outwardly from the retention members 68 to form upper tabs 69A at the intersection of the retention members 68 with the rear face 67. The outer edges 69 and associated upper tabs 69A slidingly engage the aligned parallel grooves of adjacent abutment posts of the columns of the second width 28B (see FIG. 5). Each retention member 68 includes a downwardly inclined foot 70. A downwardly inclined step 71 extends outwardly from the inner surface 67A of the rear face 67. Second adaptor 60 is constrained from further vertical downward movement by the bottom face 46 of the housing (see FIG. 10).

Figure 9:
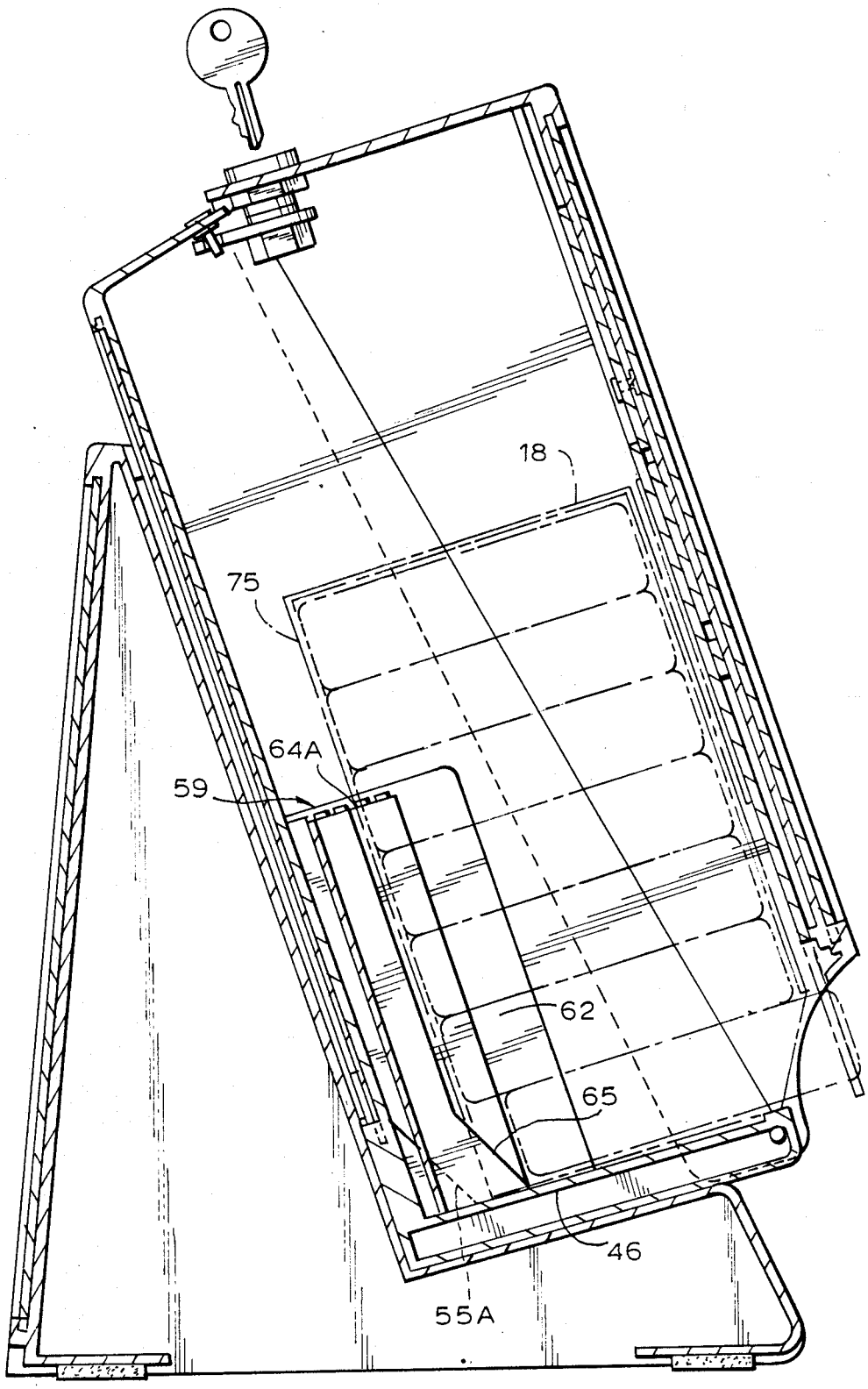
FIG. 9 is a cross-sectional side view of the display rack taken along line 9—9 of FIG. 1.
Figure 10:
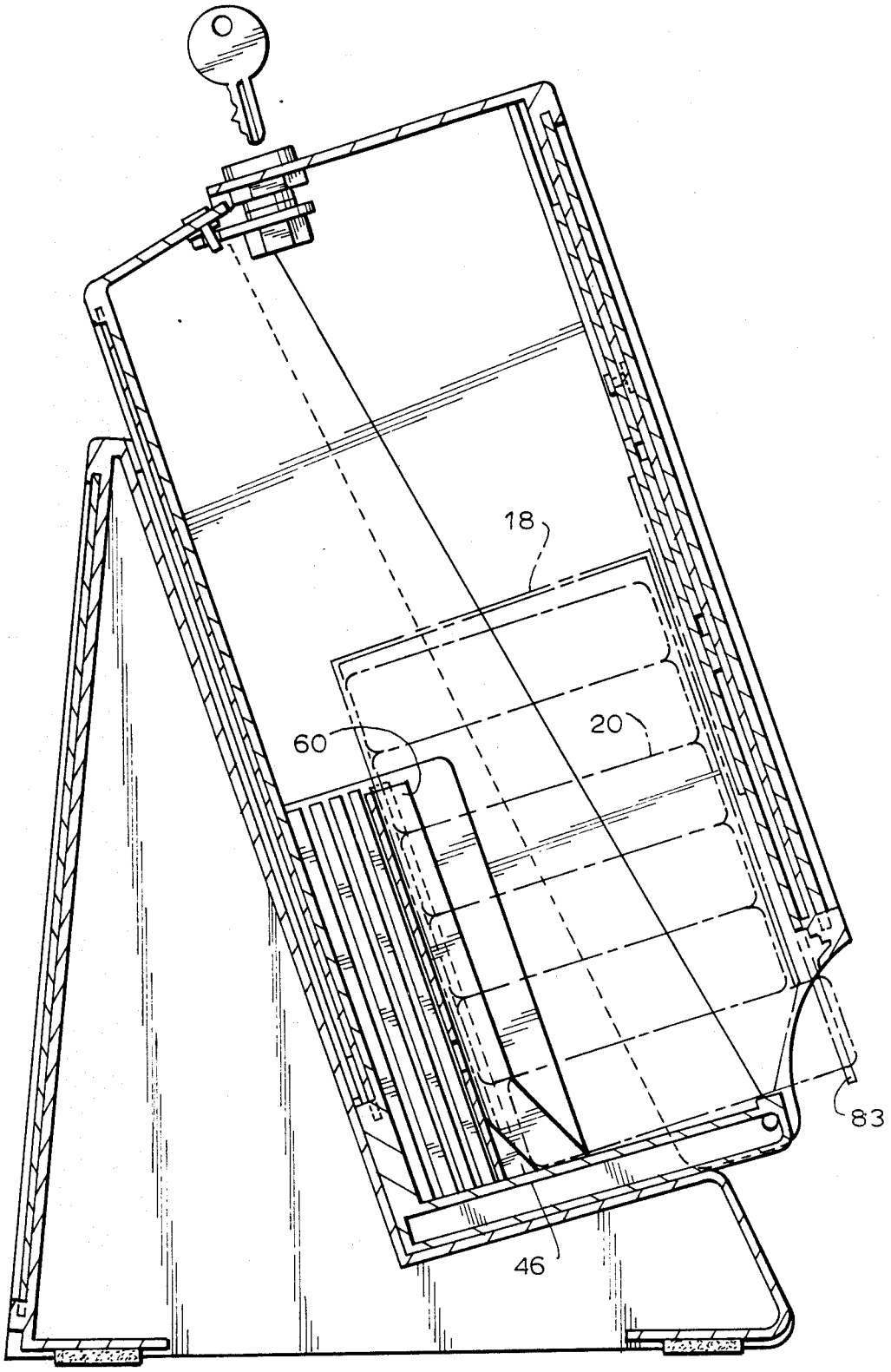
FIG. 10 is another cross-sectional side view of the display rack taken along line 10—10 of FIG. 1.
Figure 11B:
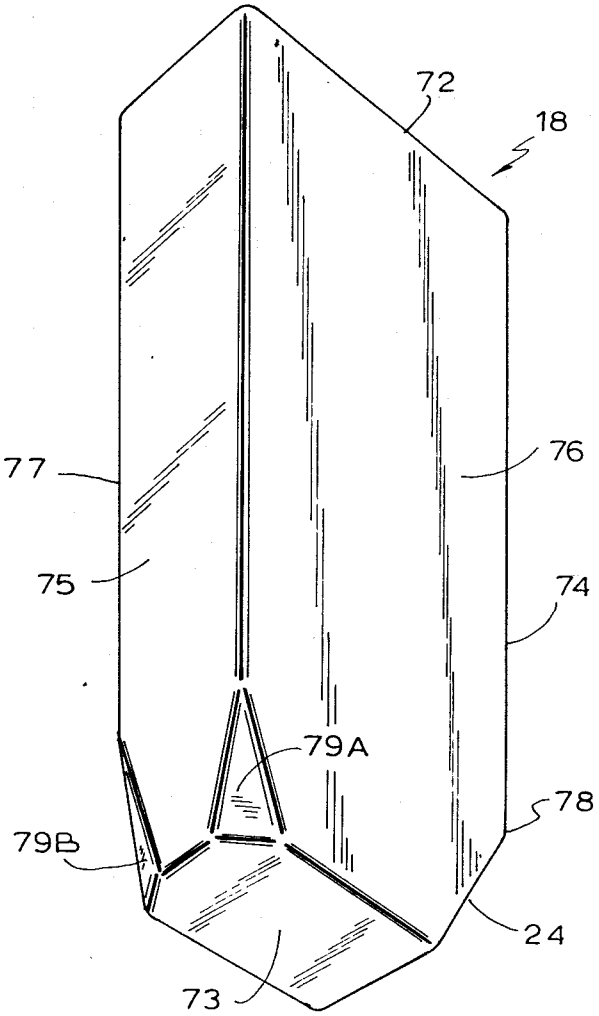
FIGS. 11A and 11B are rear perspective views of the magazine.
Figure 11A:
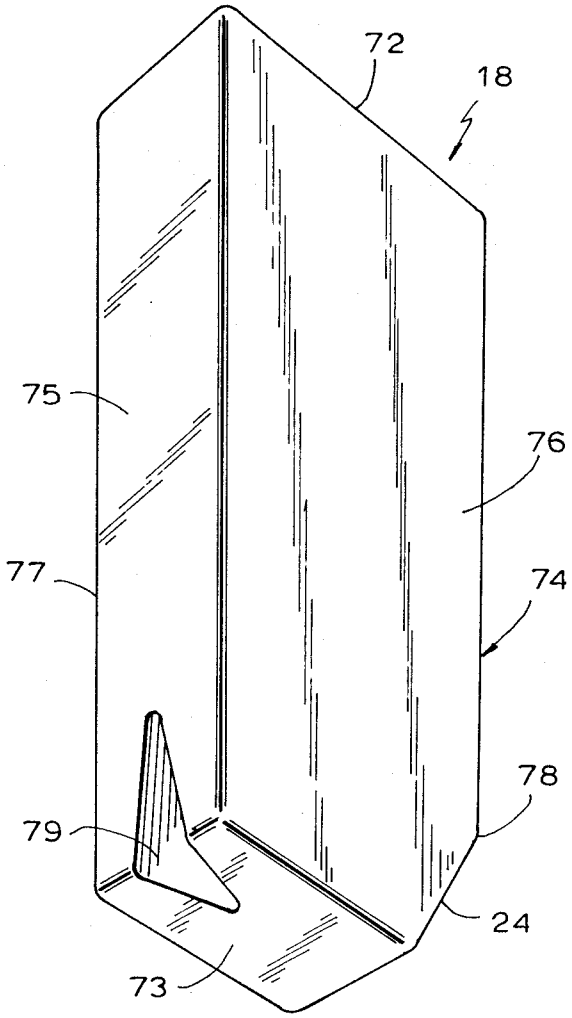

As shown in FIGS. 2, 9 and 10, magazines 18 (specifically 18B and 18C in FIG. 2) are received and retained within housing 12. Each magazine 18 contains a vertical stack of packaged items 20, such as packaged candy bars, packaged coated peanut and chocolate candy, etc. As illustrated in FIGS. 11A and 11B, each magazine 18 includes a top surface 72, bottom surface 73, front surface 74, rear surface 75 and side surfaces 76 and 77. The discharge outlet 24 of magazine 18 is formed by the space between free end 78 of front surface 74 and bottom surface 73. As shown in FIG. 11A, a notch 79 may also be formed at the bisecting corner of the bottom and rear surfaces 73 and 75, respectively, of each magazine 18. Alternatively, as shown in FIG. 11B, a pair of notches 79A and 79B may be formed at the respective corners formed by the intersection of rear surface 75, bottom surface 73 and side surface 76 and by the intersection of rear surface 75, bottom surface 73 and side surface 77 of each magazine 18.

In accordance with one of the objects of the invention, the dispenser can interchangeably accommodate varying sizes of magazines, and thus, support varying sizes of packaged items within the same display rack. The magazines may vary both as to width and depth.

Figure 6:
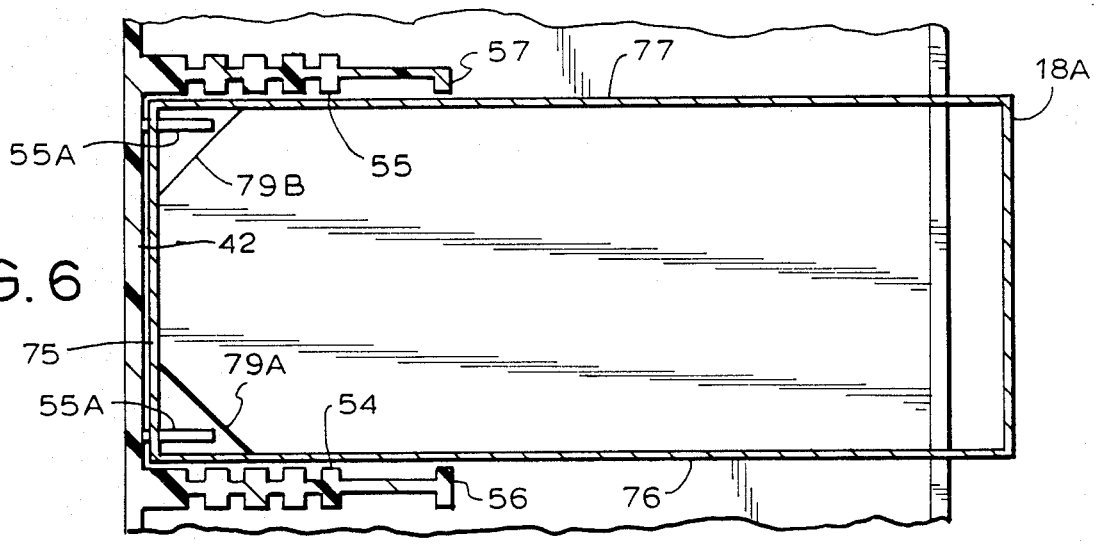
FIG. 6 is a partial cross-sectional top view of the display rack taken along line 6—6 of FIG. 1.

Referring now to FIGS. 2, 3, 6 and llB, columns of the first width 28A may receive magazines of a first size 18A. Rear surface 75 and bottom surface 73 of magazine 18A abut rear face 42 and bottom face 46 of the housing 12, respectively between abutment posts 54 and 55. Thus, lateral movement of the magazines within the columns is restrained by abutment posts 54 and 55. Lateral movement is further restrained by flanges 56 and 57 which abut side surfaces 76 and 77, respectively of magazine 18A. Downwardly inclined steps 55A insertably engage notches 79A and 79B of the magazine 18A.

The columns of the first width 28A can receive magazines of a different width by means of first adaptor 59. As shown in FIG. 5, first adaptor 59 is sized to be readily received by and be slidably engaged between aligned parallel grooves 58 of adjacent abutment posts 54 and 55 of columns 28A. The first adaptor 59 can accommodate both a second sized magazine 18B (as in FIG. 7) as well as a third sized magazine 18C (as in FIG. 8).

Figure 7:
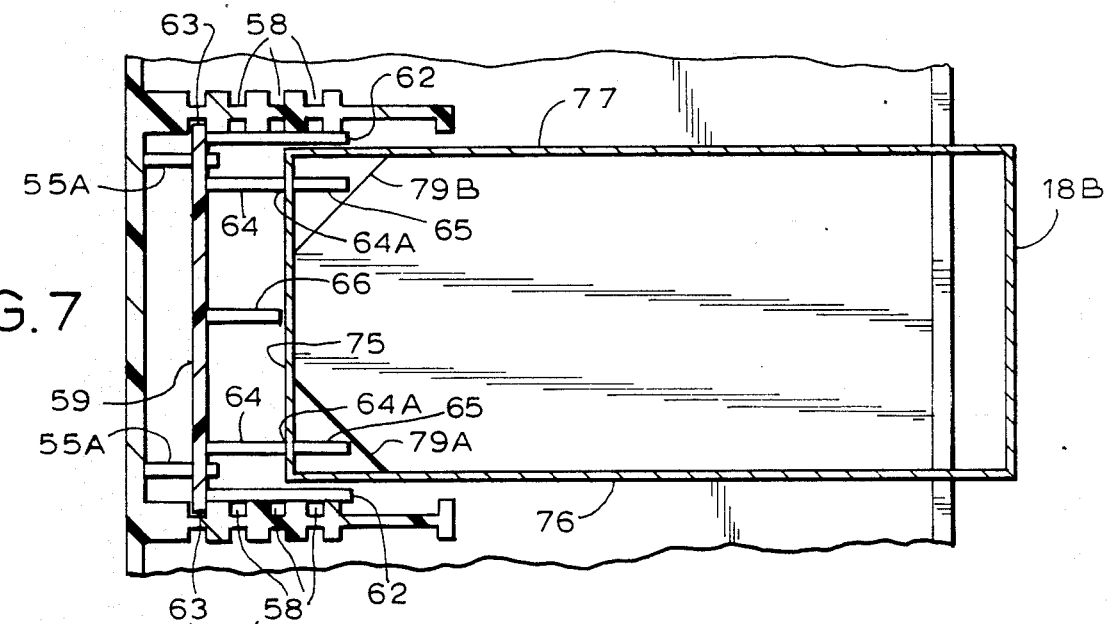
FIG. 7 is another partial cross-sectional top view of the display rack taken along line 7—7 of FIG. 2.

Referring specifically to FIG. 7, magazine 18B is received by first adaptor 59 so that rear surface 75 of magazine 18B abuts facial edges 64A of inner retention members 64 of adaptor 59. The side surfaces 76 and 77 of magazine 18B are retained by outer retention members 62. Downwardly inclined feet 65 of inner retention member 64 of the adaptor 59 insertably engage notches 79A and 79B of magazine 18B.

Figure 8:
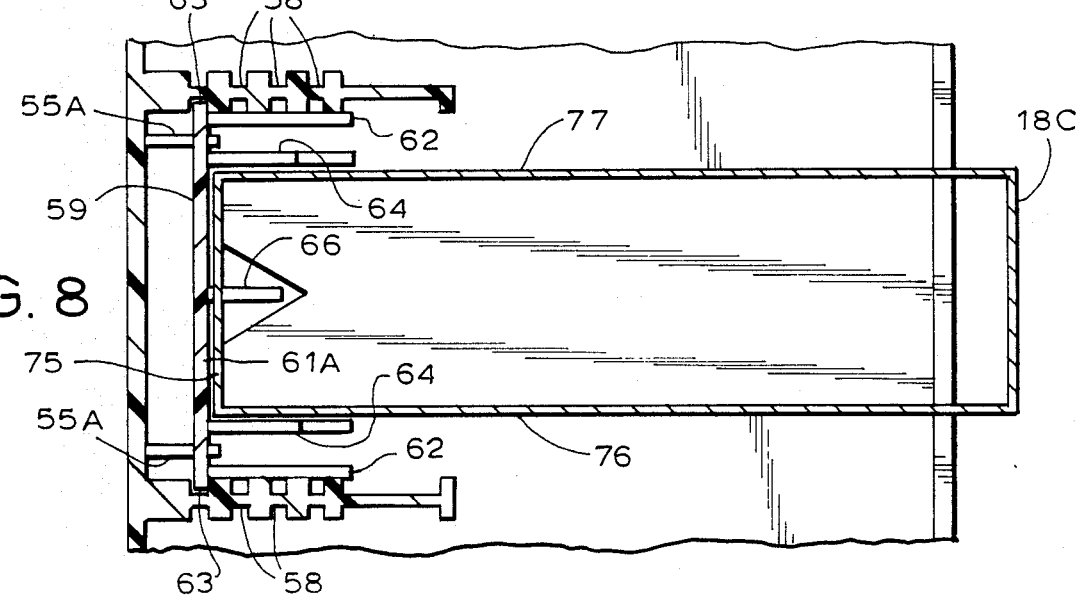
FIG. 8 is still another partial cross-sectional top view of the display rack taken along line 8—8 of FIG. 1.

Similarly, third magazine 18C is received by first adaptor 59 so that rear surface 75 of magazine 18C abuts inner surface 61A of rear face 61 of the adaptor 59. The side surfaces 76 and 77 of magazine 18B are retained by inner retention members 64 of adaptor 59 (FIG. 8). Downwardly inclined step 66 of adaptor 59 insertably engages notch 79 of magazine 18C.

Figure 12:
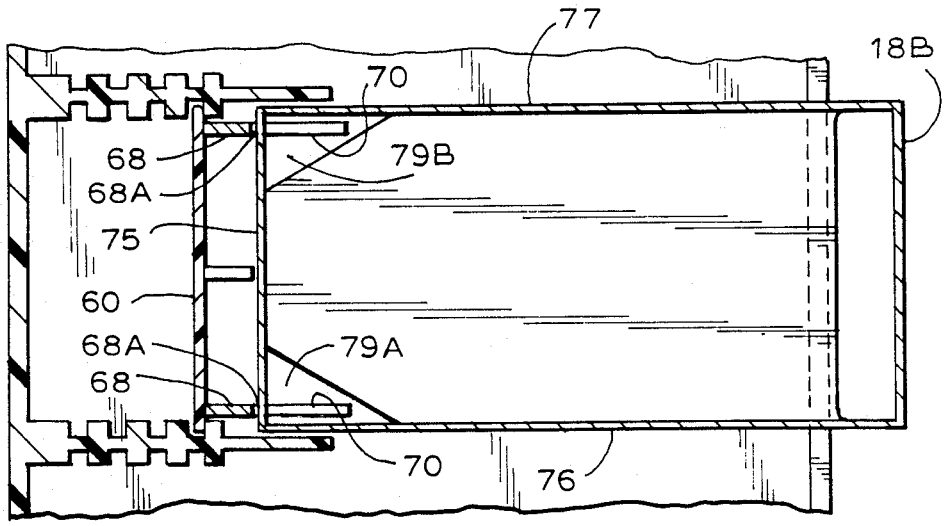
FIG. 12 is a partial cross-sectional top view of the display rack taken along line 12—12 of FIG. 1.

Columns of the second width 28B can receive magazines of differing widths by means of second adaptor 60. Second adaptor 60 is sized to be readily received by and be slidably engaged between aligned parallel grooves 58 of adjacent abutment posts 54 and 55 of columns 28B. Adaptor 60 can accommodate both second and third sized magazines 18B and 18C, respectively, (FIGS. 12 and 13).

Second sized magazine 18B is received by second adaptor 60 so that rear surface 75 of magazine 18B abuts the facial edges 68A of retention members 68 of the adaptor 60 (FIG. 12) between partition members 50 and 53. Side surfaces 76 and 77 of magazine 18B are retained by partition members 50 and 53 of the column 28B. Downwardly inclined feet 70 of the retention members 68 of adaptor 60 insertably engage notches 79A and 79B of magazine 18B.

Figure 13:
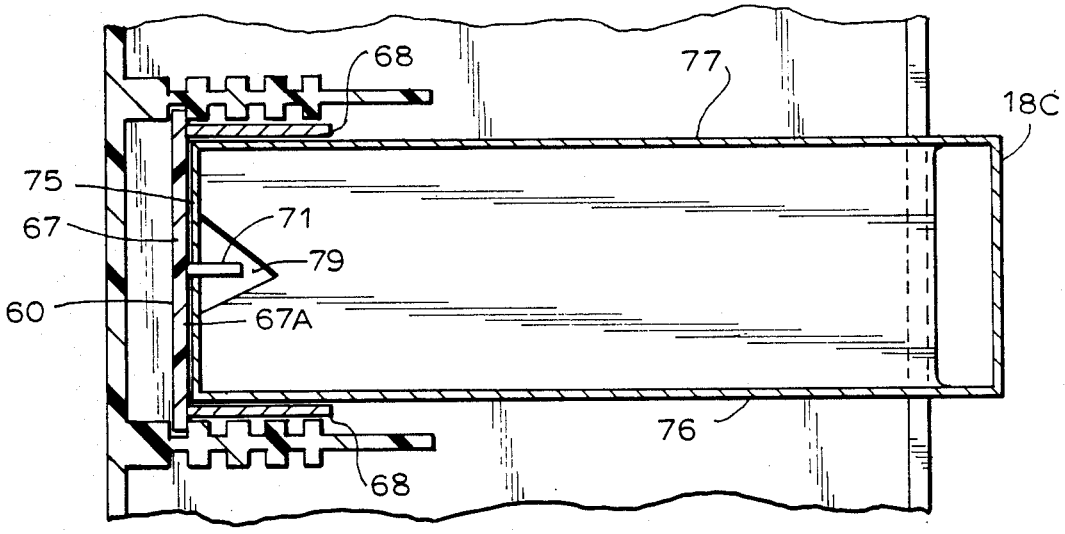
FIG. 13 is another partial cross-sectional top view of the display rack taken along line 13—13 of FIG. 1.

Third sized magazine 18C is received by second adaptor 60 so that rear surface 75 of magazine 18C abuts inner surface 67A of rear face 67 of adaptor 60 (FIG. 13). Side surfaces 76 and 77 of magazine 18C are readily received between and retained by retention members 68 of the second adaptor 60. Downwardly inclined step 71 of second adaptor 60 insertably engages notch 79 of third-sized magazine 18C.

Therefore, as shown by FIGS. 5 through 13, first and second adaptors 59 and 60 receive magazines of differing widths. Magazines of differing depths may also be accommodated within each column by varying the aligned pair of parallel grooves with which adaptors 59 and 60 slidably engage (compare FIGS. 12 and 13). In addition, first and second adaptors 59 and 60, and the various sized magazines which they receive, are interchangeably received between columns. Accordingly, the stock of packaged items to be dispensed within each column may be varied to suit customer demand.

When a magazine 18 is initially placed within column 28, discharge outlet 24, as aforedescribed, is generally aligned with discharge opening 26 of housing 12. In this manner, the leading item 22 may be withdrawn from magazine 18 through discharge opening 26. As a result of the positive gravity feed of each magazine 18, when the leading item 22 is ejected through discharge opening 26, the next leading item 80 will be placed in a position where it may be subsequently withdrawn through discharge outlet 24 and discharge opening 26.

It is essential that the time required to withdraw the packaged items from within display rack 10 be minimized to avoid delays along the cafeteria line or at the restaurant cashier's counter. Therefore, in accordance with another object of the present invention of providing a quick and efficient means for withdrawing leading packaged item 22 through discharge opening 26, downwardly inclined steps 55A, 66 and 71 and downwardly inclined feet 65 and 70, as previously described in connection with FIG. 3, are provided. These inclined feet and steps insertably engage notches 79, 79A and 79B of magazine 18. For example, as specifically shown in FIGS. 14A and 14B, when leading packaged item 22 is withdrawn through discharge opening 26, the next leading packaged item 80 will descend downwardly due to the positive gravity feed of magazine 18 striking inclined feet 65 of adaptor 59 so that next leading packaged item 80 is forced into a position where a portion of it extends outwardly of discharge opening 26. This provides for easy handling of the leading packaged item by the purchaser or clerk and prevents delays in the cafeteria or restaurant cashier check-out line.

Figure 15:
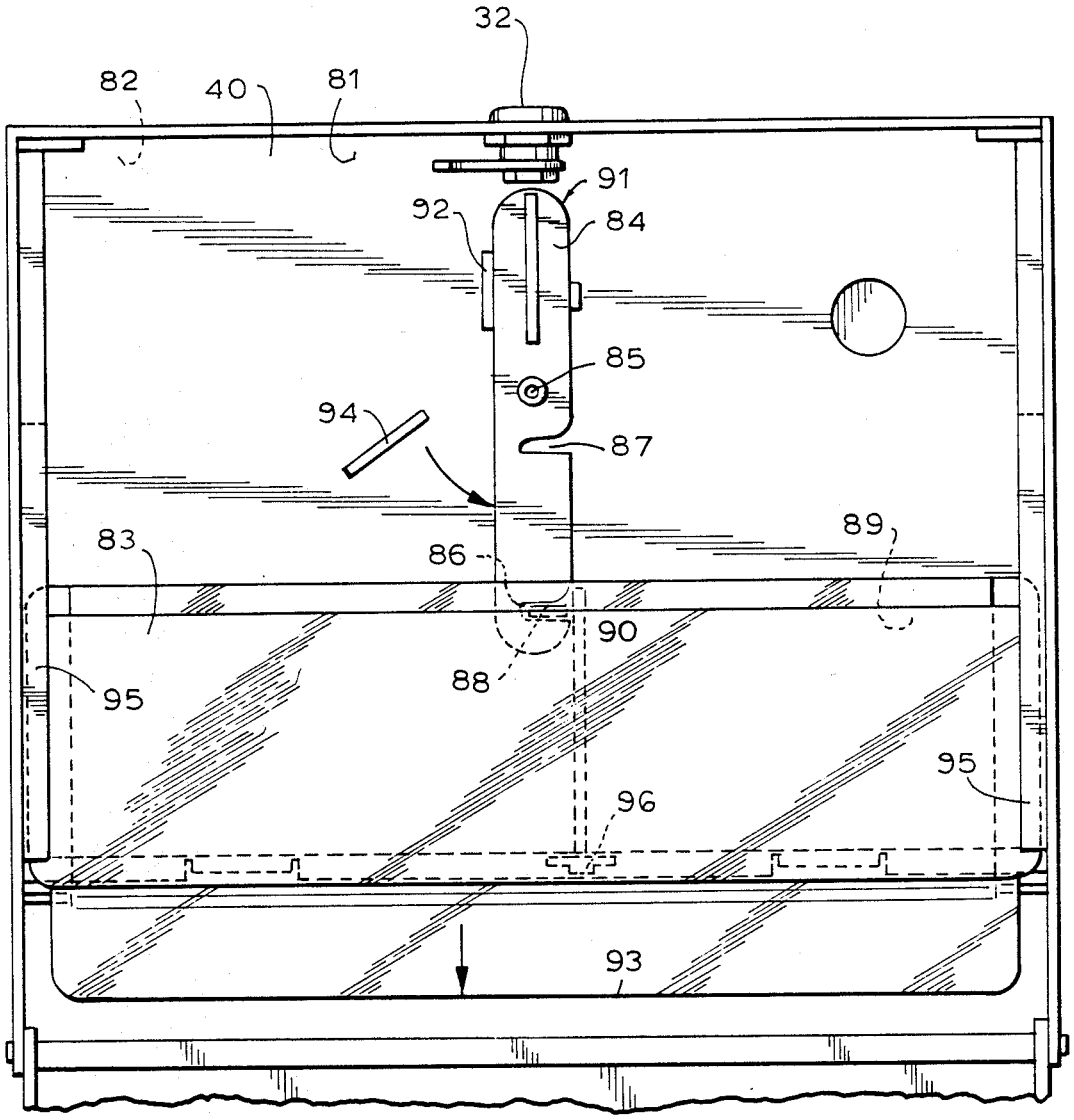
FIG. 15 is an elevational rear view of the front face of the housing illustrating the lever in its initial position and the guard in its first position.

After the business establishment (restaurant, cafeteria, etc.) is closed, it is desired that the display rack be pilfer-resistant so that employees and third persons may not abscond with the packaged items contained within the display rack. Front face 40 of housing 12 includes an inner surface 81 and an outer surface 82 (FIG. 3). A guard 83 is positioned parallel to the inner surface 81 of front face 40 and is preferably made of a plastic or plastic-like material. Guard 83 engages tracks 95 (FIGS. 15, 16 and 17) and is pivotally slidable adjacent inner surface 81. As shown in FIG. 15, guard 83 may be locked in a closed or first position whereby guard 83 covers discharge opening 26 preventing access to the packaged items 20 within magazines 18. As shown in FIG. 17, guard 83 may be locked in an open or second position whereby access is permitted to leading item 22 through discharge opening 26.

This dual locking of guard 83 is accomplished by a lever 84 being pivotally mounted to inner surface 81 of front face 40 at pivot point 85. Lever 84 includes first and second slots 86 and 87, respectively. A T-shaped clip 88 is mounted to the outer surface 89 of guard 83 adjacent to front face 40 of housing 12. Clip 88 retains first and second slots 86 and 87 when the guard 83 is moved between its first and second positions, respectively. The slots 86 and 87 are located towards the lower end 90 of lever 84 with second slot 86 being closer to the upper end 91 of lever 84 than first slot 87.

Figure 16:
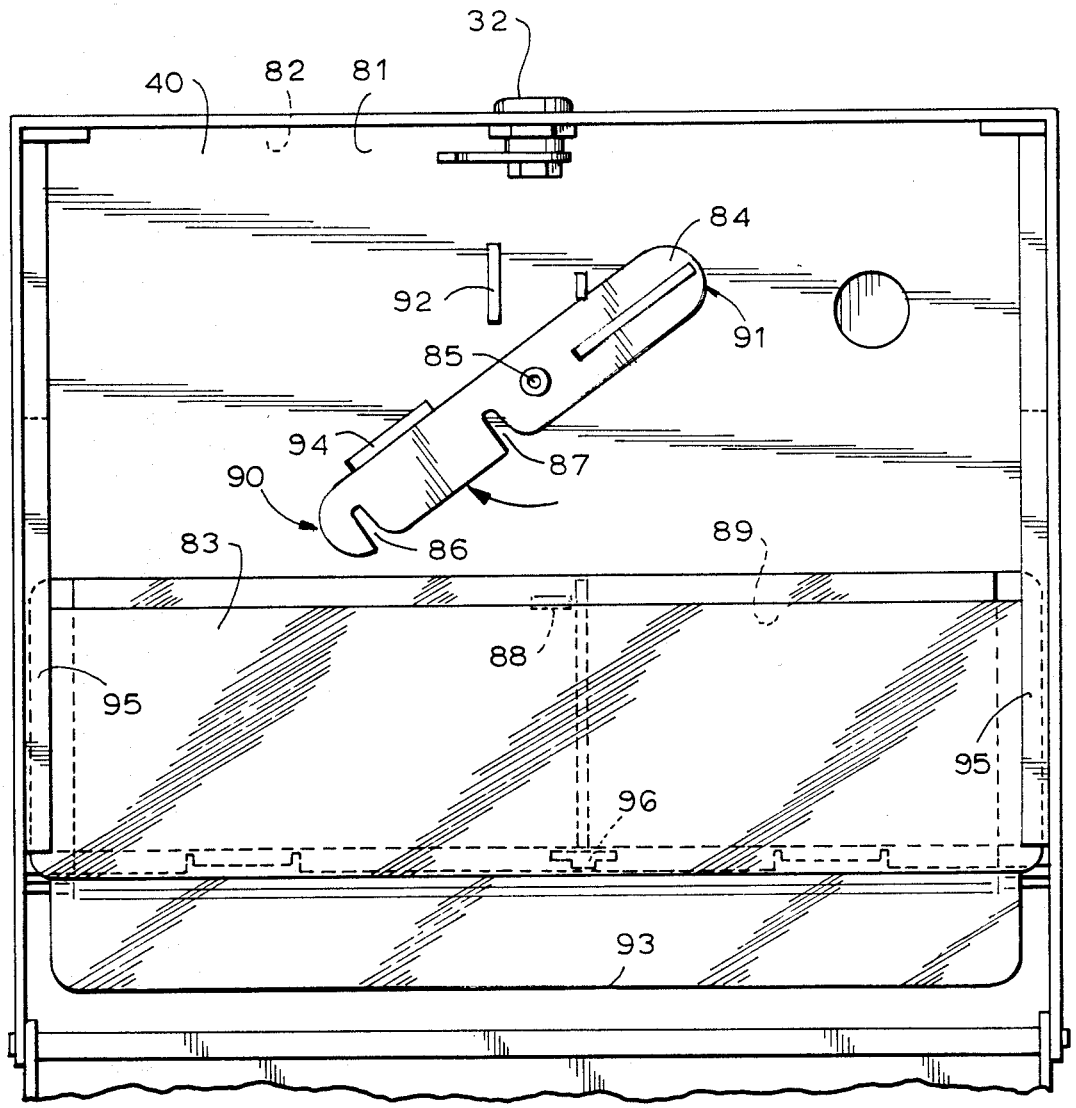
FIG. 16 is an elevational rear view of the front face of the housing specifically illustrating the lever in its intermediate position.
Figure 17:
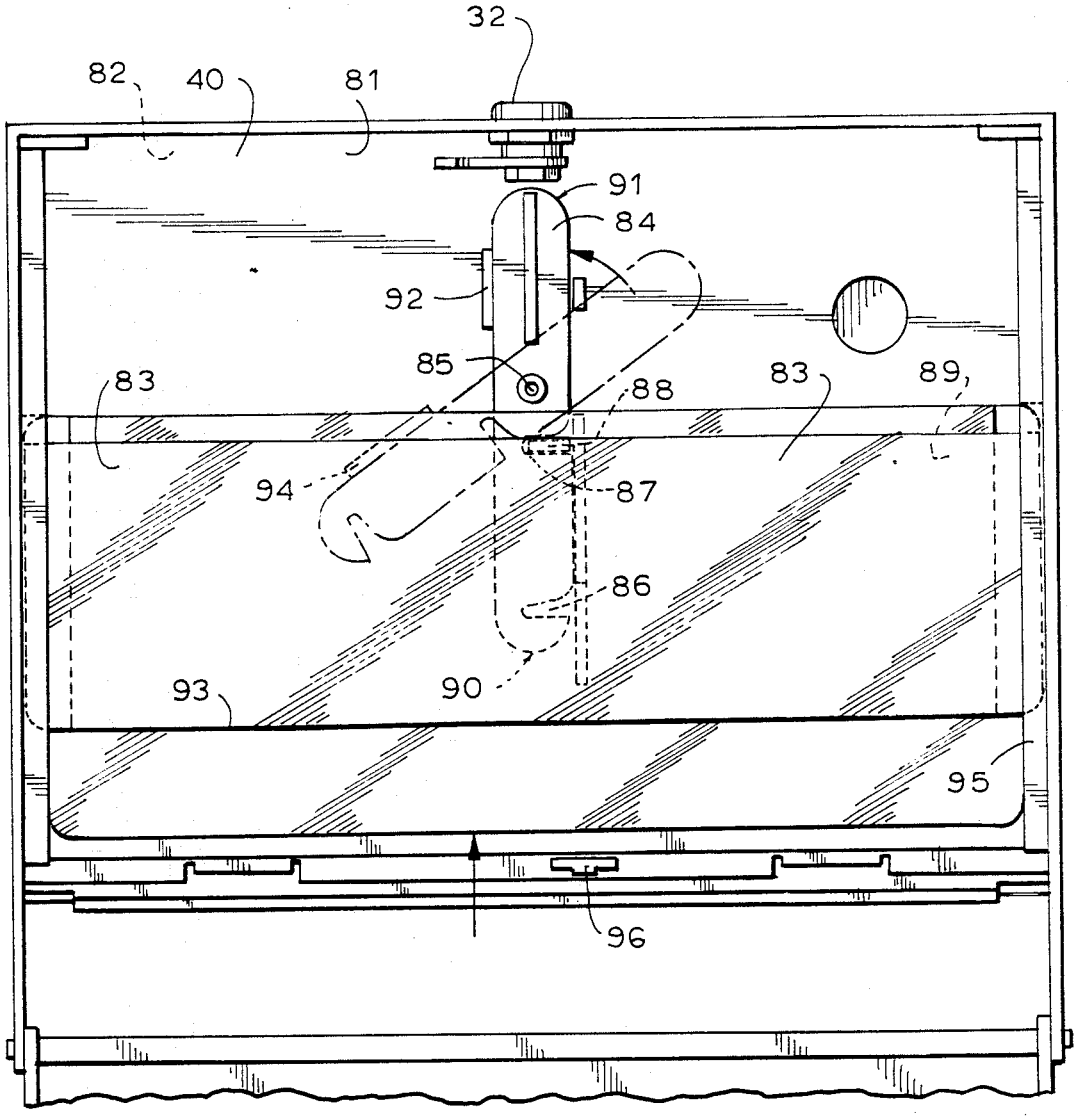
FIG. 17 is an elevational rear view of the front face of the housing specifically illustrating the lever in its final position and the guard in its second position.

The lever is displaceable between an initial position as shown in FIG. 15, an intermediate position, as shown in FIG. 16, and a final position, as shown in FIG. 17. In its initial position, lever 84 is restrained from movement by clip 88 engaging first slot 86 and a first restraining member 92 abutting upper end 91 of lever 84 to thereby lock guard 83 in its closed or first position. In its closed position, the guard 83 covers the discharge opening 26 to prevent access to the packaged items 20 within magazines 18. As best shown in FIG. 16, lever 84 may be pivoted upwardly and restrained from further upward pivotal movement by a second restraining member 94 disposed inwardly from inner surface 81 of front face 40. In this intermediate position, first slot 86 is disengaged from clip 88 and guard 83 may be moved vertically adjacent to front face 40. Finally, as shown in FIG. 17, guard 83 is moved upwardly removed from discharge opening 26 permitting access to leading item 22 within magazine 18. Lever 84 may be pivoted downwardly into its final position so that the clip 88 of the guard 83 engages second slot 87 of lever 84 to thereby lock guard 83 in its opened or second position permitting access to the packaged items through discharge opening 26. Guard 83 is also restrained from downward movement in its first position by the leading edge 93 of guard 83 contacting and abutting a third restraining member 96 inwardly disposed from the inner surface 81 of front face 40. This arrangement permitting guard 83 to be locked in its second or closed position resists pilfering of the items within the magazines and provides for a theft-resistant display rack.

It is desirous that a display rack containing vertically-stacked packaged items, such as packaged candy bars, etc., provide for an easy and effective means for inventorying the items therein after the business establishment closes each day. To accomplish this purpose, magazines 18 include slotted openings 98 along front surface 74. These slotted openings 98 permit a visual inspection of the supply of packaged items remaining in the vertical stack 20 within each magazine 18. An accurate inventory of the supply of packaged items 20 is accomplished by means of numerical indices 100 which are placed along front surface 56 adjacent to slotted openings 98, as illustrated in FIG. 2. The numerical indices 100 are spaced-apart in relation to the height of each packaged item 20 within magazine 18. In this manner, the clerk may quickly and readily inventory the packaged items within each magazine by simply opening key lock 32, separating first and second sections 27 and 29 of housing 12 relative to one another, and visually inspecting the supply of packaged items in each magazine.

In use, the vertically-stacked packaged items 20 are placed within the first, second and third-sized magazines 18A, 18B and 18C, respectively depending on the size of the packaged items. The magazines are then placed within the columns of the housing. As aforedescribed, columns of first and second width, 28A and 28B, respectively, can interchangeably receive and retain the variably sized magazines 18A, 18B and 18C. Columns 28A can directly receive the first sized magazines 18A. Column 28A may also receive second and third sized magazines 18B and 18C, respectively, by the insertion of first adaptor 59 within aligned pairs of parallel grooves of the abutment posts of columns 28A. Similarly, columns 28B can further receive magazines 18B and 18C by the insertion of second adaptor 60 within aligned pairs of parallel grooves of the abutment posts of columns 28B. In addition, magazines of differing depths can also be accommodated by the columns by changing the pair of aligned grooves with which the first and second adaptors 59 and 60 are slidably engaged. Because the variably sized magazines may be interchanged among the columns of the housing, the vendor may vary the supply of packaged items, favoring one type of candy product over another, in response to customer demand. In normal operation, leading item 22 may be withdrawn through discharge opening 26 of housing 12 which is aligned with discharge outlet 24 of the magazine.

To prevent delays at a business establishment, the ease of accessibility to the leading packaged item within the magazine is critical. Therefore, as aforedescribed, magazines 18 are placed within columns 28 such that notches 79, 79A and 79B associated with the various magazines receive inclined steps 55A, 66 and 71 and inclined feet 65 and 70 for the corresponding magazines. When the magazines are placed within columns 28, discharge outlet 24 of the magazines and discharge opening 26 of housing 12 are generally aligned. As a result thereof, when the leading packaged item 22 is withdrawn or ejected through discharge opening 26, the next leading packaged item 80 within the vertical stack of packaged items 20 descends downwardly within the magazine as a result of the positive gravity feed of the magazine striking inclined steps 55A, 66 or 71 or inclined feet 65 or 70 so that a portion of the next leading packaged item 80 extends outwardly of discharge opening 26. This permits greater accessibility to the new leading packaged item 22 by the customer or clerk.

The display rack 10 is theft-resistant in that guard 83 may be moved into a position so that it covers the discharge opening 26 of housing 12. The guard is movable between a closed or first position, wherein guard 83 covers the discharge opening preventing access to the packaged items within the magazine, and an opened or second position, wherein the guard 83 is removed from the discharge opening 26 permitting access to the leading item 22 within magazine 18. Guard 83 is locked in its first and second positions as a result of lever 84, which is displaceable between an initial position wherein lever 84 is restrained from movement by clip 88 engaging the first slot or groove 86 and a first restraining member 92 abutting upper end 89 of lever 84 to thereby lock guard 83 in its first position, an intermediate position, wherein the clip disengages the first slot 86 and the lever is pivoted upwardly away from clip 88 so that the guard may be moved to its second position, and a final position, wherein lever 84 pivots downwardly and second slot 87 engages the clip to secure guard 83 in its opened position. The guard 83 in its opened or second position is further restrained from downward movement by third restraining member 96.

An inventory of the vertical stack of packaged items within each magazine contained within housing 12 may be easily and readily obtained by opening key lock 32 and separating first and second sections 27 and 29 of housing 12 relative to one another for directly viewing the supply of packaged items 20 through the slotted openings 98. Numerical indices 100 provided along and adjacent to slotted openings 98 permit a direct and accurate inventory of the packaged items.

What is claimed is:

1. A display rack for dispensing the leading item from a vertical stack of items comprising:

a housing adapted to receive a plurality of items to be dispensed, the housing including vertical members adapted to constrain the items, a discharge opening through which each leading item is successively ejected as a result of the positive gravity feed of the housing, a front face having inner and outer surfaces, a pair of side faces, a top face, a rear face, and a bottom face, said front face extending from said top face and terminating at a free end, the distance between the free end and the bottom face defining the discharge opening;

a guard which is movable between a first position wherein the guard covers the discharge opening preventing access to the items, and a second position, wherein the guard is removed from the discharge opening permitting access to the items within the housing;

means for locking the guard in its first and second positions;

an inclined step extending upwardly from the bottom face of the housing; and a magazine for containing the vertical stack of items and having a discharge outlet therein, each successive item being removable from the magazine through the discharge outlet as a result of the positive gravity feed of the magazine, the discharge outlet being generally aligned with the discharge opening of the housing, said magazine including a groove which receives the inclined step so that when an item is ejected through the discharge opening the next leading item in the vertical stack engages the inclined step and a portion of the next leading item is extended outwardly of the discharge outlet for ease of handling during withdrawal.

2. A display rack for dispensing the leading item from a vertical stack of items comprising:

a housing adapted to receive a plurality of items to be dispensed, the housing including vertical members adapted to constrain the items, a discharge opening through which each leading item is successively ejected as a result of the positive gravity feed of the housing, a front face having inner and outer surfaces, a pair of side faces, a top face, a rear face, and a bottom face, said front face extending from said top face and terminating at a free end, the distance between the free end and the bottom face defining the discharge opening;

a guard which is movable between a first position wherein the guard covers the discharge opening preventing access to the items, and a second position, wherein the guard is removed from the discharge opening permitting access to the items within the housing;

means for locking the guard in its first and second positions including a clip mounted to the guard, a first restraining member mounted to the inner surface of the front face, and a lever pivotally mounted and including first and second slots therein and displaceable between an initial position, wherein the lever is restrained from movement by the clip engaging the first slot and the first restraining member abutting the lever to thereby lock the guard in its first position, and an intermediate position, wherein the clip disengages the first groove and the lever is pivoted away from the clip so that the guard may be moved into its second position, and a final position, wherein the lever pivots downwardly and second slot engages the clip to secure the guard in its second position; and a magazine for containing the vertical stack of items and having a discharge outlet therein, each successive item being removable from the magazine through the discharge outlet as a result of the positive gravity feed of the magazine, the discharge outlet being generally aligned with the discharge opening of the housing.

3. The display rack of claim 2 wherein the lever is restrained from further upward movement in its intermediate position by a second restraining member.

4. The display rack of claim 2 wherein the guard is restrained from downward movement in its second position by a third restraining member mounted to the front face.

5. A display rack for dispensing a leading item from a vertical stack of items comprising:

a housing adapted to receive a plurality of items to be dispensed, the housing including vertical members adapted to constrain items of varying width and a discharge opening through which each leading item is successively ejected as a result of the positive gravity feed of the housing;

adjacent parallel abutment posts defining a column of a first width;

means adapted to receive first, second and third sized magazines retaining the items therein and having a discharge outlet which is generally aligned with the discharge opening, said means capable of receiving magazines of different widths with the first-sized magazine being wider than the second-sized magazine and the second-sized magazine being wider than the third-sized magazine; and a first adapter having outer edges slidably engaging aligned parallel grooves of the adjacent abutment posts of the column of the first width wherein said first adapter has a pair of spaced-apart outer retention members and a pair of spaced-apart inner retention members, said inner retention members having facial edges, wherein the second-sized magazine is received by the first adapter such that a rear surface of the second-sized magazine abuts the facial edges of the pair of spaced-apart inner retention members of the first adapter and lateral movement of the second-sized magazine is restrained by the pair of spaced-apart outer retention members of the first adapter.

6. The display rack of claim 5 wherein the third-sized magazine is received by the first adapter such that a rear surface of the second-sized magazine abuts an inner surface of a rear face of the first adapter and lateral movement of the third-sized magazine is restrained by the pair of spaced-apart inner retention members of the first adapter.

7. The display rack of claim 5 and further including parallel, adjacent abutment posts defining a column of a second width and a second adapter having outer edges slidably engaging aligned parallel grooves of the adjacent abutment posts of the column of the second width wherein said second adapter has a pair of spaced-apart retention members, each of said retention members having facial edges wherein the second-sized magazine is received by the second adapter such that a rear surface of the second-sized magazine abuts the facial edges of the spaced-apart retention members of the second adapter and lateral movement of the second-sized magazine is restrained by the vertical members.

8. The display rack of claim 7 wherein the third-sized magazine is received by the second adapter such that a rear surface of the third-sized magazine abuts an inner surface of a rear face of the second adapter and lateral movement of the third-sized magazine is restrained by the pair of spaced-apart retention members of the second adapter.

9. The display rack of claim 7 wherein the second adapter includes at least one third inclined step extending outwardly from an inner surface of a rear face of the second adapter.

10. The display rack of claim 9 wherein the second-sized magazine further includes a second notch which receives the third inclined step so that when the leading item is ejected through the discharge opening the next leading item in the vertical stack engages the third inclined step and a portion thereof is extended outwardly of the discharge outlet for ease of handling during use.

11. The display rack of claim 9 wherein the third-sized magazine further includes a third notch which receives the third inclined step so that when the leading item is ejected through the discharge opening the next leading item in the vertical stack engages the third inclined step and a portion thereof is extended outwardly of the discharge outlet for ease of handling during use.

12. The display rack of claim 7 wherein the second adapter includes a second pair of inclined feet extending outwardly from the spaced-apart retention members of the second adapter, each foot being adjacent to the facial edges of the second adapter.

13. The display rack of claim 12 wherein the second-sized magazine further includes a first pair of notches which receive the first pair of inclined feet so that when the leading item is ejected through the discharge opening the next leading item in vertical stack engages the second pair of inclined feet and a portion thereof is extended outwardly of the discharge outlet for ease of handling during use.

14. The display rack of claim 12 wherein the third-sized magazine further includes a second pair of notches which receive the second pair of inclined feet so that when the leading item is ejected through the discharge opening the next leading item in vertical stack engages the second pair of feet, and a portion thereof is extended outwardly of the discharged outlet for ease of handling during use.

15. The display rack of claim 5 and further including at least one first inclined step extending upwardly from the bottom face of the column of the first width and the first-sized magazine further including a first notch which receives the first inclined step so that when the leading item is ejected through the discharge opening the next leading item in the vertical stack engages the first inclined step and a portion thereof is extended outwardly of the discharged outlet for ease of handling during withdrawal.

16. The display rack of claim 5 wherein the first adapter includes at least one second inclined step extending outwardly from an inner surface of a rear face of the first adapter.

17. The display rack of claim 16 wherein the second-sized magazine further includes a second notch which receives the inclined step so that when the leading item in ejected through the discharge opening the next leading item in the vertical stack engages the second inclined step and a portion thereof is extended outwardly of the discharge outlet for ease of handling during use.

18. The display rack of claim 16 wherein the third-sized magazine further includes a third notch which receives the second inclined step so that when the leading item is ejected through the discharge opening the next leading item in the vertical stack engages the second inclined step and a portion thereof is extended outwardly of the discharge outlet for ease of handling during use.

19. The display rack in claim 5 wherein the first adapter includes a first pair of inclined feet extending outwardly from the spaced-apart inner retention members of the first adapter, each foot being adjacent to the facial edges of the first adapter and wherein the second-sized magazine further includes a first pair of notches which receive the first pair of inclined feet so that when the leading item is ejected through the discharge opening the next leading item in vertical stack engages the first pair of inclined feet and a portion thereof is extended outwardly of the discharge outlet for ease of handling during use.

20. The display rack of claim 19 wherein the third-sized magazine further includes a second pair of notches which receive the first pair of inclined feet so that when the leading item is ejected through the discharge opening the next leading item in vertical stack engages the first pair of inclined feet and a portion thereof is extended outwardly of the discharge outlet for ease of handling during use.

21. A display rack for dispensing the leading item from a vertical stack of items comprising:

a housing adapted to receive a plurality of items to be dispensed, the housing including vertical members which are formed integrally with said housing and which are adapted to constrain the items and a discharge opening through which each leading item is successively ejected as a result of the positive gravity feed of the housing, and said housing further including a front face having inner and outer surfaces, a pair of side faces, a top face, a rear face, and a bottom face, said front face extending from said top face and terminating at a free end, the distance between the free end and the bottom face defining the discharge opening;

a guard which is movable between a first position wherein the guard covers the discharge opening preventing access to the items, and a second position, wherein the guard is removed from the discharge opening permitting access to the items within the housing;

an inclined step extending upwardly from the bottom face of the housing; and a magazine for containing the vertical stack of items and having a discharge outlet and a notch which receives the inclined step so that when an item is ejected through the discharge opening the next leading item in the vertical stack engages the inclined step and a portion of the next leading item is extended outwardly of the discharge outlet for ease of handling during withdrawal, each successive item being removable from the magazine through the discharge outlet as a result of the positive gravity feed of the magazine, the discharge outlet being generally aligned with the discharge opening of the housing.

22. The display rack of claim 21 wherein the vertical members insertably receive the magazine therebetween and restrain lateral movement thereof in the housing.

23. The display rack of claim 21 wherein the housing includes first and second sections hingedly connected relative to one another, the housing being displaceable between a closed position wherein the first and second sections are interlocked, and an open position, wherein the first section is disengaged from the second section for direct access to the items.

24. The display rack of claim 21 wherein the magazine further includes a means to inventory the supply of items within the magazine.

25. The display rack of claim 21 wherein the means to inventory the supply of items within each magazine includes slotted openings within the magazine for viewing the inventory of items within the magazine; and a plurality of numerical indices in spaced-apart relation corresponding to the height of each item in the associated magazine, the numerical indices being positioned immediately adjacent the slotted openings permitting a direct and accurate inventory of the items within each magazine.

26. The display rack of claim 21 wherein the means for locking the guard further includes a third restraining member mounted to the front face and wherein said guard is restrained from downward movement in its second position by said third restraining member.

27. The display rack of claim 21 wherein a column is defined by parallel partition members extending from the rear face of the housing, the parallel partition members restraining lateral movement of the magazine within the column.

28. A display rack for dispensing the leading item from a vertical stack of items comprising:

a housing adapted to a receive a plurality of items to be dispensed, the housing including vertical members which are formed integrally with said housing and which are adapted to constrain the items and a discharge opening through which each leading item is successively ejected as a result of the positive gravity feed of the housing and said housing further including a front face having inner and outer surfaces, a pair of side faces, a top face, a rear face, and a bottom face, said front face extending from said top face and terminating at a free end, the distance between the free end and the bottom face defining the discharge opening;

a guard which is movable between a first position wherein the guard covers the discharge opening preventing access to the items, and a second position, wherein the guard is removed from the discharge opening permitting access to the items within the the housing;

a clip mounted to guard;

a first restraining member mounted to the inner surface of the front face;

a lever pivotally mounted and including first and second slots therein and displaceable between an initial position, wherein the lever is restrained from movement by the clip engaging the first slot and the first restraining member abutting the lever to thereby lock the guard in its first position, and an intermediate position, wherein the clip disengages the first groove and the lever is pivoted away from the clip so that the guard may be moved into its second position, and a final position, wherein the lever pivots downwardly and second slot engages the clip to thereby lock the guard in its second position; and a magazine for containing the vertical stack of items and having a discharge outlet therein, each successive item being removable from the magazine through the discharge outlet as a result of the positive gravity feed of the magazine, the discharge outlet generally aligned with the discharge opening of the housing.

29. The display rack of claim 28 wherein the lever is restrained from further upward movement in its intermediate position by a second restraining member.

30. A display rack for dispensing a leading item from a vertical stack of items comprising:

a housing adapted to receive a plurality of items to be dispensed, the housing including vertical members adapted to constrain items of varying width;

a discharge opening through which each leading item is successively ejected as a result of the positive gravity feed of the housing; and means adapted to received first, second and third-sized magazines of varying width and depth retaining the items therein, each of said magazines having a discharge outlet which is generally aligned with said discharge opening, said receiving means including adjacent parallel abutment posts defining a column and an adapter having outer edges slidably engaging aligned parallel grooves of the adjacent abutment posts of the column wherein said adapter has a pair of spaced-apart outer retention members and a pair of spacedapart inner retention members, said inner retention members having facial edges, said inner and outer retention members capable of varying both the depth and the width of said column to receive said magazines.

31. The display rack of claim 30 wherein said means adapted to receive said magazines can receive magazines of different widths with the first-sized magazine being wider than the second-sized magazine and the second-sized magazine being wider than the third-sized magazine.

32. The display rack of claim 30 wherein the first-sized magazine is received by the column and lateral movement of the first-sized magazine is restrained by the adjacent abutment posts.

33. The display rack of claim 30 wherein the second-sized magazine is received by the adapter such that a rear surface of the second-sized magazine abuts the facial edges of the pair of spaced-apart inner retention members of the adapter and lateral movement of the second-sized magazine is restrained by the pair of spaced-apart outer retention members of the adapter.

34. The display rack of claim 30 wherein the third-sized magazine is received by the adapter such that a rear surface of the second-sized magazine abuts an inner surface of a rear face of the adapter and lateral movement of the third-sized magazine is restrained by the pair of spaced-apart inner retention members of the adapter.

35. The display rack of claim 30 wherein the housing comprises a front face, a pair of side faces, a top face, a rear face, and a bottom face; the front face extending from the top face and terminating at a free end; the distance between the free end and the bottom face defining the discharge opening.

36. The display rack of claim 30 wherein the adapter includes at least one second inclined step extending outwardly from an inner surface of a rear face of the adapter.

37. The display rack of claim 36 wherein the second-sized magazine further includes a second notch which receives the inclined step so that when the leading item is ejected through the discharge opening the next leading item in the vertical stack engages the second inclined step and a portion thereof is extended outwardly of the discharge outlet for ease of handling during use.

38. The display rack of claim 36 wherein the third-sized magazine further includes a third notch which receives the second inclined step so that when the leading item is ejected through the discharge opening the next leading item in the vertical stack engages the second inclined step and a portion thereof is extended outwardly of the discharge outlet for ease of handling during use.

39. The display rack in claim 30 wherein the adapter includes a first pair of inclined feet extending outwardly from the spaced-apart inner retention members of the adapter, each foot being adjacent to the facial edges of the adapter.

40. The display rack of claim 39 wherein the second-sized magazine further includes a first pair of notches which receive the first pair of inclined feet so that when the leading item is ejected through the discharge opening the next leading item in vertical stack engages the first pair of inclined feet and a portion thereof is extended outwardly of the discharge outlet for ease of handling during use.

41. The display rack of claim 39 wherein the third-sized magazine further includes a second pair of notches which receive the first pair of inclined feet so that when the leading item is ejected through the discharge opening the next leading item in vertical stack engages the first pair of inclined feet and a portion thereof is extended outwardly of the discharge outlet for ease of handling during use.

42. The display rack of claim 30 wherein the adapter includes a second pair of inclined feet extending outwardly from the spaced-apart retention members of the adapter, each foot being adjacent to the facial edges of the adapter.

43. The display rack of claim 42 wherein the second-sized magazine further includes a first pair of notches which receive the first pair of inclined feet so that when the leading item is ejected through the discharge opening the next leading item in vertical stack engages the second pair of inclined feet and a portion thereof is extended outwardly of the discharge outlet for ease of handling during use.

44. The display rack of claim 42 wherein the third-sized magazine further includes a second pair of notches which receive the second pair of inclined feet so that when the leading item is ejected through the discharge opening the next leading item in vertical stack engages the second pair of feet, and a portion thereof is extended outwardly of the discharged outlet for ease of handling during use.

45. A display rack for dispensing a leading item from a vertical stack of items comprising:

a housing adapted to receive a plurality of items to be dispensed, the housing including vertical members adapted to constrain items of varying width;

a discharge opening through which each leading item is successively ejected as a result of the positive gravity feed of the housing; and means adapted to receive first, second and third-sized magazines of varying width and depth retaining the items therein, each of said magazines having a discharge outlet which is generally aligned with said discharge opening, said receiving means including parallel adjacent abutment posts defining a column and an adapter having outer edges slidably engaging aligned parallel grooves of the adjacent abutment posts of the column wherein said adapter has a pair of spaced-apart retention members, each of said retention members having facial edges, said inner and outer retention members capable of varying both the depth and the width of said column to receive said magazines.

46. The display rack of claim 45 wherein the sized magazine is received by the adapter such that a rear surface of the second-sized magazine abuts the facial edges of the spaced-apart retention members of the adapter and lateral movement of the second-sized magazine is restrained by the vertical members.

47. The display rack of claim 45 wherein the third-sized magazine is received by the adapter such that a rear surface of the third-sized magazine abuts an inner surface of a rear face of the adapter and lateral movement of the third-sized magazine is restrained by the pair of spaced-apart retention members of the adapter.

48. The display rack of claim 45 wherein the adapter includes at least one third inclined step extending outwardly from an inner surface of a rear face of the adapter.

49. The display rack of claim 48 wherein the second-sized magazine further includes a second notch which receives the third inclined step so that when the leading item is ejected through the discharge opening the next leading item in the vertical stack engages the third inclined step and a portion thereof is extended outwardly of the discharge outlet for ease of handling during use.

50. The display rack of claim 48 wherein the third-sized magazine further includes a third notch which receives the third inclined step so that when the leading item is ejected through the discharge opening the next leading item in the vertical stack engages the third inclined step and a portion thereof is extended outwardly of the discharge outlet for ease of handling during use.

51. A display rack for dispensing a leading item from a vertical stack of items comprising:

a housing adapted to receive a plurality of items to be dispensed, the housing including vertical members adapted to constrain items of varying width;

a discharge opening through which each leading item is successively ejected as a result of the positive gravity feed of the housing; and means adapted to received first, second and third-sized magazines of varying width and depth retaining the items therein, each of said magazines having a discharge outlet which is generally aligned with said discharge opening, and said first magazine further including a notch, said receiving means including adjacent parallel abutment posts defining a column having a bottom face; and at least one first inclined step extending upwardly from the bottom face of the column which step is received by said notch so that when the leading item is ejected through the discharge opening the next leading item in the vertical stack engages the first inclined step and a portion thereof is extended outwardly of the discharge outlet for ease of handling during withdrawal.

* * * * *